United States Patent [19]

Voges

[11] Patent Number: 4,531,873

[45] Date of Patent: Jul. 30, 1985

[54] APPARATUS FOR FEEDING A CUT PORTION OF ADHESIVE STRIP TO A DEVICE FOR STICKING THE BACK OF A BOOK BLOCK

[75] Inventor: Wolfgang Voges, Erlangen, Fed. Rep. of Germany

[73] Assignee: Claus Koenig KG, Erlangen, Fed. Rep. of Germany

[21] Appl. No.: 495,587

[22] Filed: May 18, 1983

[30] Foreign Application Priority Data

Jun. 2, 1982 [DE] Fed. Rep. of Germany ..... 3220789

[51] Int. Cl.[3] ..... B42B 5/04; B65H 17/26

[52] U.S. Cl. ..... 412/36; 226/128

[58] Field of Search ..... 412/6, 8, 16, 37, 901, 412/36, 27; 83/277, 409, 607; 226/127, 128, 129, 130, 132, 133

[56] References Cited

U.S. PATENT DOCUMENTS 1,638,816 8/1927 Krueger ..... 226/128

1,658,989 2/1928 Keck ..... 226/128

4,178,201 12/1979 Power et al. ..... 412/36

*Primary Examiner*—Paul A. Bell

*Assistant Examiner*—Paul M. Heyrana, Sr.

*Attorney, Agent, or Firm*—Banner, Birch, McKie & Beckett

[57] ABSTRACT

Apparatus for feeding a cut portion of adhesive strip for sticking the back of a book block or the like has a path for longitudinally guiding the adhesive strip drawn from a roll. In the path, a severing blade is located above a working table upstream from a deposit means for the portion of adhesive strip. Laterally of the working table and parallel to the deposit means is a slide guide having a slide from which projects a gripper having a clamp for gripping the end of the adhesive strip which is held in a waiting position at the cutting location of the severing blade. The slide guide extends from the region of the severing blade to beyond the end of the deposit means and stops are provided in the course of the slide guide means for stopping the slide.

9 Claims, 4 Drawing Figures

APPARATUS FOR FEEDING A CUT PORTION OF ADHESIVE STRIP TO A DEVICE FOR STICKING THE BACK OF A BOOK BLOCK

FIELD OF THE INVENTION

This invention relates to an apparatus for feeding a cut portion of adhesive strip to a device for sticking the back of a book block or the like, having a path for longitudinally guiding the adhesive strip which is drawn from a roll, in the course of which path a severing blade is arranged above a working table, upstream of a deposit means for the portion of adhesive strip.

BACKGROUND OF THE INVENTION AND PRIOR ART

A device of this kind is disclosed in German patent specification No. 1 486 747 (P 502). In that device, for the purposes of feeding the cut portion of adhesive strip to the sticking station, use is made of the book block itself. The book block is fitted with its back on the working table upstream of the severing blade, the book block gripping a short portion of adhesive strip with the front end of the book block. The adhesive strip which is cut off by the severing blade directly upstream of the leading end of the back of the book block is then entrained along the path, when the book block is moved, until the trailing end of the book block has just passed the severing blade. The severing blade is then operated once again to cut through the adhesive strip, thereby providing a cut portion of adhesive strip which is substantially adapted to the length of the book block and which is stuck to the back of the book block. The book block is then guided along the path to a deposit means for the adhesive strip portion, with the adhesive strip portion being entrained therewith; at that location, the adhesive strip portion is stuck to the book block in a manner which does not concern us here.

When the device is one in which the adhesive strip portion is to be fed alone to the deposit means, and at that location the book block is placed on the adhesive strip portion by means which do not concern us here, then in the known device, it would be necessary to feed the adhesive strip portion by hand. That is disadvantageous because of the danger of soiling, and that operation generally cannot be carried out with the necessary degree of accuracy. Added to that is the fact that, when using an adhesive strip from a fusion-type adhesive, there would be the danger of burning.

OBJECT OF THE INVENTION

An object of the invention is to provide an apparatus for feeding a cut portion of adhesive strip to a device of the above-indicated kind, which avoids the above-mentioned disadvantages and wherein the adhesive strip is fed semi-automatically with such a degree of accuracy that in particular identical book blocks can be rapidly stuck in succession, with a portion of adhesive strip which is cut to the respective correct length.

SUMMARY OF THE INVENTION

According to the invention the apparatus includes a slide guide means having a slide arranged parallel to the deposit means laterally on the working table, and a gripper having a clamping means for gripping the end of the adhesive strip, which is held in the waiting position at the cutting location of the severing blade, projecting out of the slide, the slide guide means extending from the region of the severing blade to beyond the end of the deposit means and stops for stopping the slide being provided in the course of the slide guide means.

Arranging the slide guide means laterally on the working table leaves the working table substantially free so that an adhesive strip which is drawn along the path by means of the gripper can be properly observed by the operator, in regard to the position of the adhesive strip. The gripper which extends from the slide into the region of the path, with its clamping means for gripping the respective end of the adhesive strip, does not cover over the adhesive strip as the gripper with its clamping means is disposed in front of the respective end of the adhesive strip, in the adhesive strip feed direction. In that connection, the range of movement of the slide, by virtue of its being arranged laterally on the working table, may be readily provided with stops for stopping the slide so that the slide may automatically take up the respective position required for cutting off a portion of adhesive strip and for guiding it to the deposit means, without any need for the operator to be particularly careful and attentive, by virtue of the provision of the stops. If the device is a device for processing adhesive strips which are provided with a fusion-type adhesive, there is no danger to the operator from the point of view of burning, in that connection, as the operator does not need to touch the adhesive strip portion at all with his hands.

Desirably, the apparatus has a first stop for the slide, for stopping the slide in an initial position in which the clamping means extends beyond the cutting location, in the opposite direction to the adhesive strip feed direction, by such a distance that the end of the adhesive strip can be gripped by the clamping means. That arrangement provides that, for gripping the end of the adhesive strip which is held in the waiting position, the slide only has to be moved up to the first stop, whereby the clamping means automatically takes up its position required for gripping the end of the adhesive strip. By suitably actuating the clamping means, when it comes up against the first stop, it engages beyond the end and is then closed, whereupon the adhesive strip can be drawn off the roll.

In order to cut off a portion of adhesive strip of given length, in particular on a recurring or periodic basis, the apparatus is desirably provided with a second stop which is so adapted that it can be overrun by the slide and which stops the slide in a severing position in which the respectively required length of adhesive strip portion is drawn over the cutting location. The second stop is arranged adjustably, for the purposes of adaptation to the length of the respective book block to be stuck. By virtue of the second stop being arranged in that way, when the slide encounters the second stop, the adhesive strip is drawn from the roll by a respective distance corresponding to the length of movement of the slide between the first and second stops, thereby defining the length of the cut portion of adhesive strip. Therefore, by virtue of the two stops, the operator does not have to use any particular care in regard to the length of the adhesive strip which is drawn off the roll, as the first and second stops precisely define the length of the respective cut portion of adhesive strip.

In order to make the second stop easily adjustable, the second stop is desirably mounted on a longitudinally displaceable and arrestable bar which is disposed parallel to the slide guide means on the working table. The bar is then to be set in each case in such a way that, when the slide reaches the second stop, the portion of adhesive strip is of the desired length.

Such setting of the second stop may advantageously be effected by means of a book block to be stuck, in that the first stop and the slide have mutually facing parallel end faces which bear against each other in the initial position and which at the same time form the contact faces for a book block which is laid therebetween, for the purposes of setting the second stop. The book block itself therefore defines the length of the movement of the slide from the first stop (initial position) to the second stop (severing position) in which the adhesive strip is cut off to form the cut portion of the desired length. When dealing with a plurality of identical book blocks to be stuck, the second stop naturally remains in the set position so that portions of adhesive strip which are always of the same length are successively cut off, without re-setting the apparatus.

The operation of sticking a book block with an adhesive strip portion is now necessarily effected at a certain spacing from the severing blade as the mechanism thereof could interfere with the sticking operation. Accordingly, in the above-mentioned known device, after the adhesive strip portion has been cut off, it is moved on along the path into the deposit means. Now, in this connection, in order also to make the apparatus easier to handle from the point of view of the operator, the apparatus advantageously has a third stop which stops the slide in an end position in which the front end of the adhesive strip portion is disposed at the level of the respective end of the book block to be stuck. As a limit means is usually provided for the book block sticking operation which does not particularly concern us here, with the book block being pushed away from the severing location and bearing against the limit means, in the longitudinal direction of the path, in order for the book block to be in a respective defined position, it is possible to automate the step of terminating the movement of the slide in the above-mentioned end position by means of the third stop, as for that purpose the third stop only has to be positioned, as mentioned above, in such a way that, when the slide bears against the third stop, the front end of the adhesive strip portion is to arrive at a location or feed position at which the front end of the adhesive strip portion is aligned with the respective end of the book block to be stuck. When the book block is brought together with the adhesive strip portion, that automatically results in the book block and the adhesive strip portion being joined together, without the adhesive strip projecting beyond the ends of the book block.

In the above-mentioned end position, that is to say, when the slide bears against the third stop, the front end of the adhesive strip portion must be released by the clamping means so that the end can be completely stuck to the back of the book block in question. A simple way of moving the clamping means away from the above-mentioned end of the adhesive strip portion is for the third stop to be so constructed that it can be overrun by the slide. In that case, more specifically, after the arrangement reaches the end position, the clamping means is opened and the slide overruns the third stop, whereby the adhesive strip portion can be completely released and exposed, and thus stick to the book block.

An advantageous embodiment in respect of the gripper provides that the gripper comprises a bottom plate and a clamping plate which is movable relative thereto and which is pressed by a spring loading against the bottom plate, with the two plates projecting on the slide transversely with respect to the slide guide means, and the gripper comprising angular tongue portions which are directed in the direction of the path, opposite to the adhesive strip feed direction, the ends of the tongue portions forming the clamping means, with the clamping plate actuated by a hand lever mounted on the side, for the purposes of opening the clamping means. When the lever is operated, the clamping means is opened whereby on the one hand the end of the adhesive strip, that is held in the waiting position, is gripped, and on the other hand, the adhesive strip portion which is guided into the deposit means is released.

Desirably, mounted on the side is a retractible slider member which co-operates with the second and third stops. By retracting the slider member, it is possible for the slide to overrun or move beyond the second and third stops respectively.

In order to make the movement of the slider member as convenient and as comfortable as possible for the operator, the slider member is desirably suspended on the hand lever in such a way that, upon actuation of the lever, both for opening the clamping means and also in the opposite direction to movement thereof, for opening the clamping means, the slider member is retracted from the second or third stop respectively. Therefore, for moving the slide and the slider member, the arrangement has only a single hand lever which is only to be operated in opposite directions, in each case.

When using a self-sticking adhesive, it may happen that, when the clamping means is opened in the end position, the clamping plate of the clamping means may entrain the respective end of the adhesive strip portion so that that end is not released from the clamping plate side of the clamping means. In order to ensure that the end of the adhesive strip portion is released in that way, the bottom plate side of the clamping means is advantageously provided with a wire spring which extends along the respective tongue portion and which, when the clamping means is in the closed condition, passes through a slot in the clamping plate side of the clamping means and holds the respective end of the adhesive strip between itself and the bottom plate side of the clamping means, and, when the clamping means is opened and the adhesive strip is entrained by the clamping plate side of the clamping means, strips the end of the adhesive strip portion from that side. In that arrangement, there is virtually no possibility of the adhesive strip sticking to the wire spring, because of the small contact area between the wire spring and the adhesive strip.

Other objects and features of the invention will become apparent from the following detailed description of preferred but non-limitative embodiments and the accompanying drawings made a part hereof and to which reference is made.

BRIEF DESCRIPTION OF THE DRAWINGS

FIG. 1 shows a device 1 for sticking the back of a book block or the like, having a path 2 for longitudinally guiding the adhesive strip 4 which is drawn off the roll 3. On the working table 5 of the device 1, the path 2 is enclosed by the two longitudinal rails or bars 6 and 7 which are mounted on the working table 5 and between which an adhesive strip cut portion to be stuck in place is guided. In that arrangement, the region of the path 2, which is in front of the limit means 8, forms the deposit means 9 for deposit of the cut portion of adhesive strip, the adhesive strip portion being guided into the deposit means 9 for the sticking operation, with the leading end of the respective adhesive strip portion being stopped by the limit means 8. The limit means 8 is fixed on the working table 5, laterally in the path 2, between the longitudinal bars 6 and 7. Directly upstream of the path 2 is the severing blade 10 which engages into an aperture 11 in the working table 5. The severing blade 10 is mounted rotatably underneath the working table 5, in a manner which does not concern us here. The cutting edge 12 of the severing blade is pressed directly against the co-operating blade 13 which projects slightly out of the aperture 11 so as to give a clean cutting operation when the severing blade 10 is operated. The adhesive strip roll 3 is mounted on a spindle 14 which is carried by two arms of which only the arm 15 is visible here. The arms are secured in the interior of the device 1, in a manner which does not concern us here.

Figure 1:
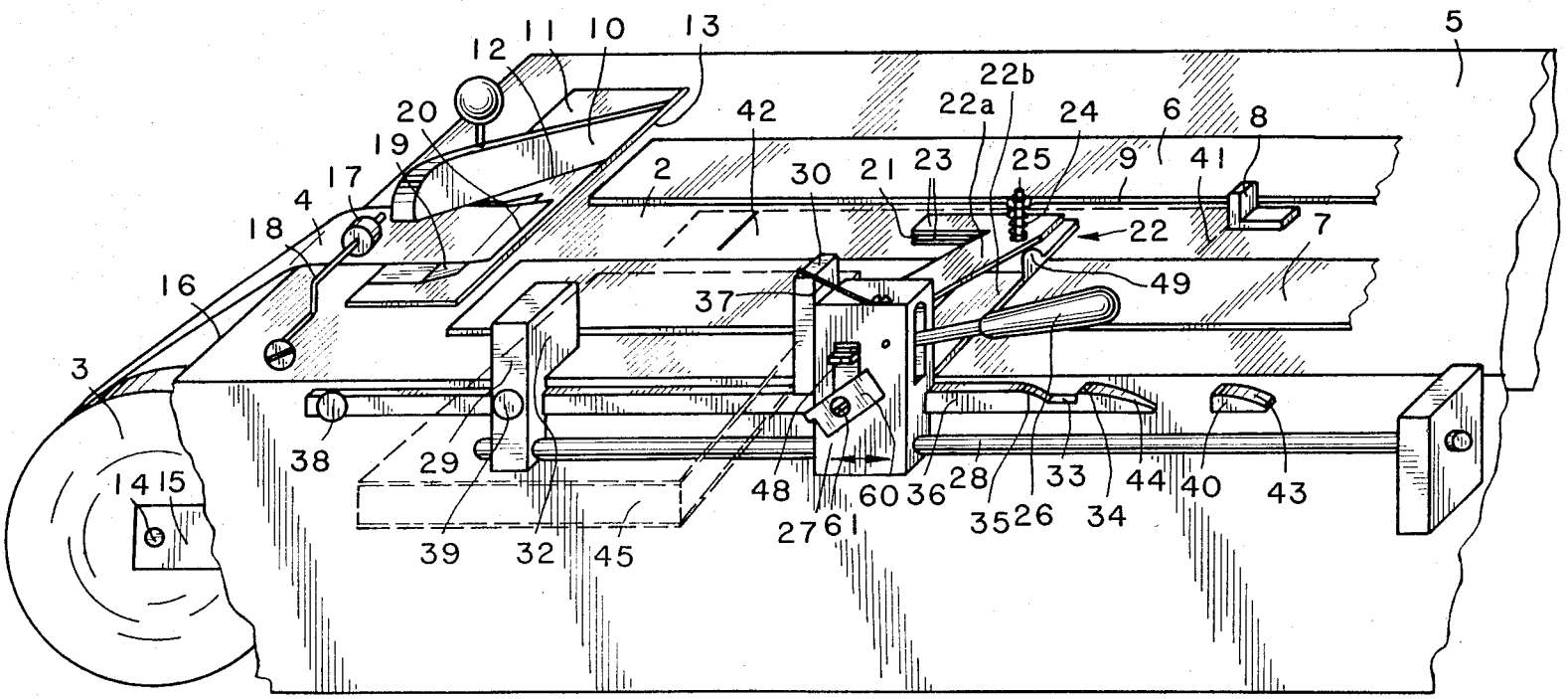
FIG. 1 shows a perspective view of the apparatus together with the parts that concern us in this context, of a device for sticking the back of a book block.

The adhesive strip 4 is drawn off the roll 3 over the rounded edge 16 of the working table 5, with the adhesive strip 3 being passed through below a retaining means comprising a pressure roller 17, and initially being laid over the co-operating blade 13. The pressure roller 17 is mounted on the spring 18 which is secured to the working table 5 and which constantly urges the pressure roller 17 towards the working table 5. An adhesive strip 4 which is under the pressure roller 17 is prevented from slipping away by the pressure roller 17. In its movement from the pressure roller 17 to the co-operating blade 13, the adhesive strip 4 passes over the lifting means 19 which is arranged in the aperture 11 and which ensures that the leading end 20 of the adhesive strip 4 is held in a position of being lifted away from the co-operating blade 13 after operation of the severing blade 10 so that the leading end of the adhesive strip can be gripped by the clamping means 21, as will be described in greater detail hereinafter.

For the purposes of feeding the adhesive strip 4 to the deposit means 9 in front of the limit means 8, the arrangement has the gripper 22 which comprises a clamping plate 22*a* and a bottom plate 22*b*, both of which are shaped to form the tongue portions 23, the ends of which form the clamping means 21. The tongue portions 23 extend substantially in the direction of the path 2 in such a way that an end of the adhesive strip, which is gripped by the clamping means 21, can be drawn along the path 2, while the position of the adhesive strip on the path 2 can be readily observed, because it is exposed. The clamping plate 22*a* and the bottom plate 22*b* are urged together by the compression spring 24 which is disposed on the bolt 25 secured to the bottom plate 22*b* and projecting through the clamping plate 22*a*. The compression spring 24 continuously applies a pressure to the clamping plate 22*a* to urge it towards the bottom plate 22*b* so that the clamping means 21 tends to close. Actuation of the clamping means 21 is by means of a hand lever 26, the function of which will be described in greater detail hereinafter with reference to FIG. 2.

The gripper 22 projects transversely with respect to the path 2 out of the slide 27 on which the hand lever 26 is also mounted. The slide 27 is carried on the slide guide means 28 which is in the form of a round bar and which is disposed laterally beside the working table 5, parallel to the path 2 and the deposit means 9. For the purposes of gripping the end 20 of the adhesive strip 4, the slide 27 is moved towards the left until it encounters the first stop 29. The stop 29 is secured to the working table 5. The slide guide means 28 also terminates in the stop 29, being fixedly mounted therein. The slide 27 is provided with the slider member 30 which is vertically displaceable relative to the slide 27, more specifically, by means of the hand lever 26, to which further reference will be made below. When the slide 27 encounters the stop 29, the end face 31 (see FIG. 2) of the slider member 30 is in contact with the end face 32 of the first stop 29, thereby providing a defined position, namely the initial position, for the slide 27. In that initial position, the clamping means 21 which is slightly opened by means of the hand lever 26 in that position engages beyond the end 20 of the adhesive strip 4 and grips the end 20 by virtue of the hand lever 26 being moved into the rest position, whereby the clamping means 21 closes under the force of the compression spring 24 and thus grips the end 20 of the adhesive strip 4. The slide 27 is now displaced towards the right from the above-described initial position (not shown) into the severing position. The severing position is defined by virtue of slider member 30 engaging into the groove 33 formed in the bar 36. The groove 33 is defined on one side by the second stop 34 and at its other side, by the inclined portion 35. The slider member 30 is pressed against the bar 36 by a spring 37 so that, when the slide 27 is displaced towards the right, the slider member 30 finally slides over the inclined portion 35 into the groove 33 and is retained by the second stop 34, so that further movement of the slide 27 towards the right is terminated. In order to permit such movements, the bar 36 extends through the slide 27. The manner in which the bar 36 extends through the slide 27 forms one mounting means for the bar 36. At its other end, it is mounted displaceably in the first stop 29. At its lefthand end, it has a knob 38 which can be gripped and by means of which the bar 36 can be moved backwards and forwards in its longitudinal direction. For the purposes of arresting or locking the bar 36, the arrangement has a locking knob or button 39 which is carried by means of screwthreads in the first stop 29 and which presses against the bar 36. When the knob or button 39 is tightened, the bar 36 is locked in its respective position.

It should now be supposed that, in the severing position of the slide 27, in which therefore the slider member 30 has engaged into the groove 33, such a length of adhesive strip 4 has been drawn off over the co-operating blade 13 that actuation of the severing blade 10 produces a cut portion of adhesive strip, of such a length as to correspond to the length of the respective book block to be stuck. The slide 27 is then moved further towards the right along the slide guide means 28, for which purpose the slide 27 overruns the stop 34. That is effected by lifting the slider member 30 by means of the hand lever 26. The mode of operation in this respect will be described in greater detail hereinafter, with reference to FIG. 2. By virtue of the slider member 30 being lifted, the second stop 34 releases the slider member 30 so that the slide 27 can continue to be moved towards the right; more specifically, the slider member 30 which has now been let down again comes into contact with the stop 40 that is secured to the table plate 5. The position of the third stop 40 is such that the slide 27, on reaching that stop, assumes its end position in which at the same time the leading end 41 of the respective adhesive strip portion 42 which is shown in broken lines, bears against the limit means 8. The limit means 8 is arranged to the side in the path 2 or the deposit means 9, to such an extent that the tongue portions 23 can be moved past the limit means 8.

In the end position which is thus reached, the adhesive strip portion in question is in the arrangement referred to as the deposit means 9, that is to say, the location at which the adhesive strip portion 42 is brought into contact with the book block to be stuck, which in per se known manner itself occupies a given position which is aligned with the deposit means 9. For example, such a book block may be applied to the adhesive strip portion 42 from above.

In order now that the clamping means 21 can be moved completely away from the adhesive strip portion 42 in order to permit the above-indicated sticking operation to be carried out, the third stop 40 is also of such a nature that it can be overrun. In order to produce the overrun effect, the slider member 30 is lifted by means of the hand lever 26 in the manner already described above, whereby the slide 27 can continue its movement towards the right, more specifically, until the clamping means 21 which is now opened by means of the hand lever 26 releases the end 41 of the adhesive strip portion 42.

In order to permit the slide 27 to be returned to the above-described initial position without special actuation of the hand lever 26, the arrangement has inclined surfaces or portions 43 and 44 which are disposed laterally beside the third stop 40 and the second stop 34 and by means of which the slider member 30 is automatically lifted. The same function is performed by the inclined surface or portion 35.

FIG. 1 also shows in broken lines a book block 45 which is disposed between the stop 29 and the slider member 30 and which can be used automatically to set the second stop 34 in such a way as to provide an adhesive strip portion of a length which is identical to the length of the book block 45. As will be seen from the drawing, the book block 45 is disposed between the face 32 of the first stop 29 and the face 31 (see FIG. 2) of the slider member 30, whereby the book block 45 provides a defined position for the slide 27. If now after the locking knob or button 39 is released, the bar 36 is displaced towards the left by means of the knob 38, the slider member 30 which is loaded by the spring 37 finally engages into the groove 33 and bears against the second stop 34. When now the knob 39 is tightened, the stop 34 is locked in the appropriate severing position for the book block 45. When the book block 45 is removed, the slide 27 is then displaced towards the left until it reaches the first stop 29 (see the above description) from which the end 20 of the adhesive strip 4 is then gripped and is introduced into the path 2 as far as the severing location at which a cut portion of adhesive strip is then cut off by actuating the severing blade 10, the length of the cut portion of adhesive strip precisely corresponding to the length of the book block 45 to be stuck.

Figure 2:
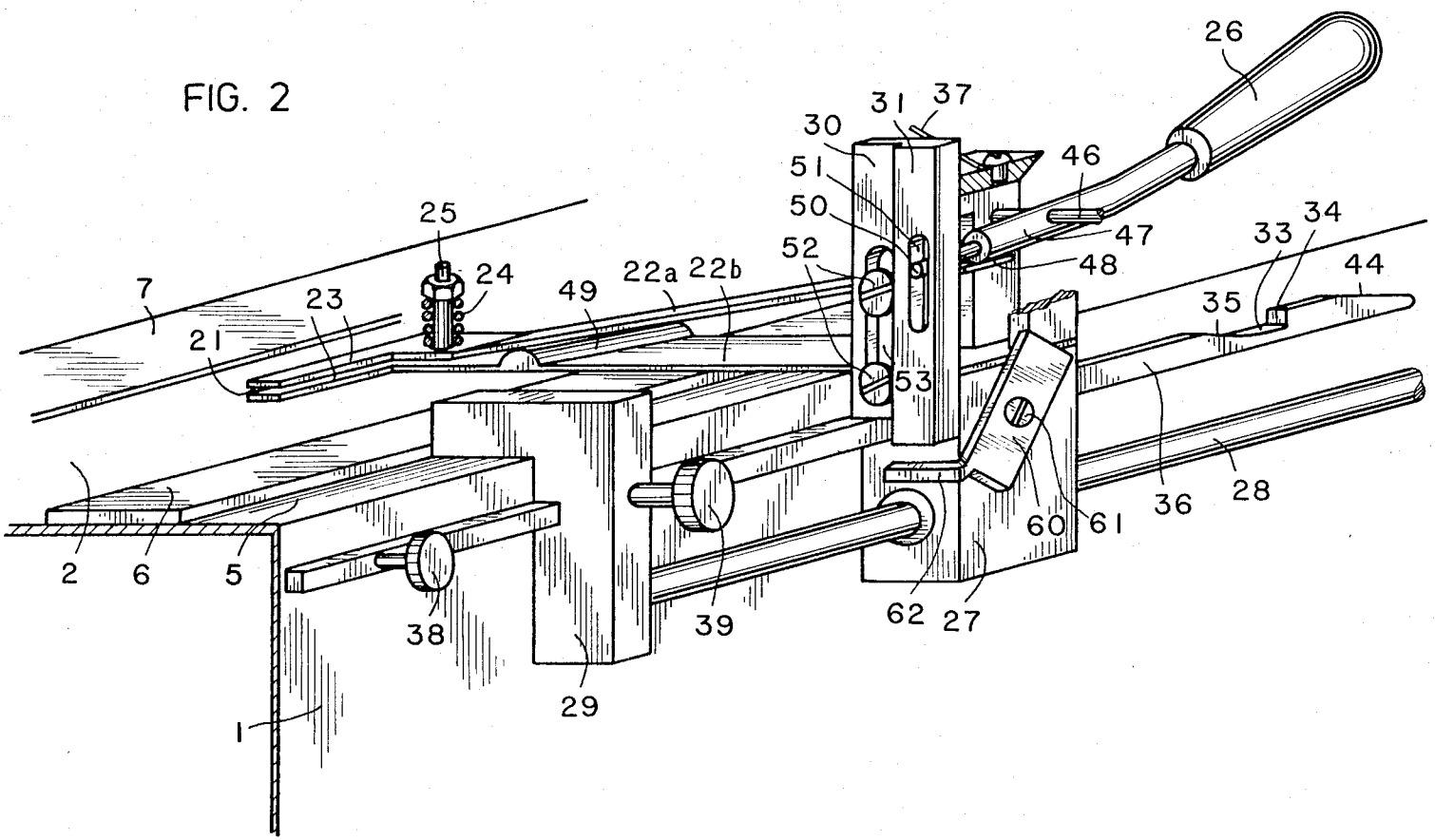
FIG. 2 shows another perspective view of the same apparatus, concentrating on the slider member with the gripper.
Figure 3:
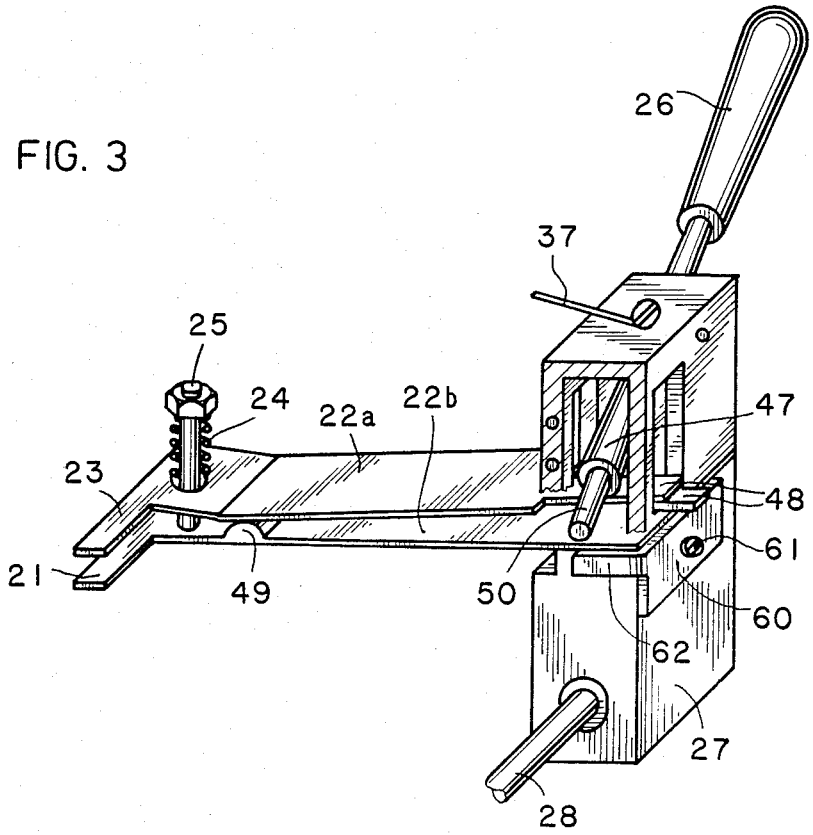
FIG. 3 shows the slider member with gripper alone.

Reference will now be made to FIGS. 2 and 3 to describe the mode of operation of the gripper 22 with the bottom plate **22*b* and the clamping plate 22*a*, and the slider member 30. As shown in FIG. 2, the hand lever 26 is mounted on the shaft or spindle 46, within the slide 27, in such a way that the hand lever 26 presses with its end 47 on to the end 48 of the clamping plate 22*a*. The clamping plate 22*a* rolls upon the bead or raised portion 49 which is provided on the bottom plate 22*b*. By virtue of that configuration, and in association with the compression spring 24, the mode of operation is therefore such that, when the hand lever 26 is lifted away from the working table 5, the end 47 of the hand lever 26 presses against the extension portion 48 of the clamping plate 22*a* whereby the latter, together with the tongue portion 23 constituting an extension thereof, is lifted, so that the clamping means 21 is opened in that manner. When the hand lever 26 is pressed towards the working table 5, the pressure plate 22*a* is unaffected thereby, but the pin 50 which projects out of the end 47 of the hand lever 26 entrains the slider member 30, which has such a clearance for movement in the slot 51 of the slider member 30 that, when the hand lever 26 is lifted, the pin 50 leaves the slider member 30 unaffected. However, the downward movement of the end 47 of the hand lever 26, which is produced when the hand lever 26 is raised, causes the above-mentioned downward movement of the extension portion 48 which finally bears against the pivoting or tilting lever 60 which thus rotates about the spindle or shaft 61 which is in the form of a screw member and, by means of a bent portion 62, lifts the slider member 30 from below (see the position of the lever 60 shown in FIG. 3). By virtue of the slider member 30 being lifted in the above-indicated manner, the slider member is lifted away from the second stop 34 or the third stop 40 respectively, in the manner described hereinbefore. FIG. 3 does not show the slider member 30, for the sake of enhanced clarity of the drawing. The slider member 30 is held to the slide 27 by means of the two screws 52 which slide with a reciprocating movement in the slot 53. FIG. 3 shows the clamping means 21** in the open position.

Figure 4:
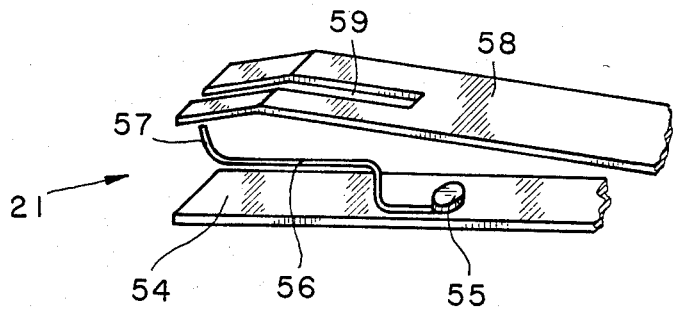
FIG. 4 shows a particular configuration of the clamping means.

FIG. 4 shows a particular embodiment of the clamping means 21. A wire spring 56 is secured by means of a screw 55 to the lower tongue portion 54 as illustrated in FIG. 4, the wire spring 56 extending in the longitudinal direction of the lower tongue portion 54 towards the open end of the clamping means 21 and terminating in a bent portion 57. When the clamping means 21 is in a closed condition, with the upper tongue portion 58 bearing against the lower tongue portion 54 (FIG. 4 shows the clamping means 21 in the open position), the wire spring 56 extends through the slot 59 in the upper tongue portion 58 so that it therefore permits movement of the upper tongue portion 58 for closing the clamping means 21, without being impeded by the wire spring 56. With this embodiment of the clamping means 21, the respective end of the clamping strip is introduced in such a way that it lies between the lower tongue portion 54 and the wire spring 56. The end of the adhesive strip can then be readily gripped between the two tongue portions 54 and 58. If then, by virtue of the adhesive strip sticking, the adhesive strip is entrained by the upper tongue portion 58 when the clamping means 21 is opened, the wire spring 56 strips the end of the adhesive strip off the upper tongue portion 58. Because of the small contact area involved, there is virtually no sticking as between the wire spring 56 and the end of the adhesive strip. However, if such a contact effect could result in the components sticking together, the wire spring 56 may be provided with a silicone tube portion thereon. The bent portion 57 serves to facilitate inserting the end of the adhesive strip between the wire spring 56 and the lower tongue portion 54.

We claim:

1. Apparatus for feeding a cut portion of adhesive strip for sticking the back of a book block comprising: a working table having means defining a path for longitudinally guiding an adhesive strip across said table; a holder for a roll of adhesive strip mounted at one end of said path; a severing blade arranged above said working table in the course of said path; deposit means for the portion of adhesive strip on said table; slide guide means having a slide arranged parallel to said deposit means disposed laterally along one side of said working table, said slide guide means extending from the region of said severing blade to a location beyond the end of said deposit means; a gripper supported by said slide guide means having a clamping means for gripping the end of the adhesive strip to be held in a waiting position at the cutting location of said severing blade; a first stop for stopping said slide in the course of said slide guide means, said first stop being operative to stop said slide in an initial position in which said clamping means extends beyond said cutting location for a distance such that the end of the adhesive strip can be gripped by said clamping means; a second stop for stopping said slide in the course of said slide guide means, said second stop being operative to stop said slide in a severing position at which the required length of adhesive strip has been drawn past said cutting location, said slide being releasible from said second stop for said slide to over run said second stop; a third stop for said slide mounted to stop said slide in an end position in which the leading end of the adhesive strip portion is located at the intended end of the book block to be stuck.

2. Apparatus according to claim 1, in which the second stop is adjustably locatable for adaptation to the length of the respective book block to be stuck.

3. Apparatus according to claim 2, in which the second stop is mounted on a longitudinally displaceable, arrestable bar which is arranged parallel to the slide guide means on the working table.

4. Apparatus according to claim 3, in which the first stop and the slide have parallel end faces which face towards each other and which bear against each other in the initial position, and which at the same time form the contact faces for a book block which is laid therebetween, for the purposes of setting the second stop.

5. Apparatus according to claim 1, in which the third stop is constructed so that it can be overrun.

6. Apparatus according to claim 5, in which the gripper comprises a bottom plate and a clamping plate which is movable relative to the bottom plate and which is urged by a spring loading against the bottom plate, and the two plates project out of the slide transversely with respect to the slide guide means and each have a respective angular tongue portion, the tongue portions being directed into the path in the opposite direction to the feed direction of the adhesive strip and the ends of the tongue portions forming the clamping means, there being a hand lever arranged on the slide to act on the clamping plate for the purposes of opening the clamping means.

7. Apparatus according to claim 6, in which a retractable slider member is mounted on the slide and cooperates with the second and third stops.

8. Apparatus according to claim 7, in which the slider member is suspended on the hand lever in which a way that, upon actuation of the hand lever in one direction the clamping means is opened and when the hand lever is actuated in the opposite direction both the clamping means is opened and the slider member is retracted.

9. Apparatus according to claim 8, in which the bottom plate of the clamping means is provided with a wire spring which extends longitudinally of the respective tongue portion and which, when the clamping means is in a closed condition, extends through a slot in the clamping plate side of the clamping means and holds the respective end of the adhesive strip between itself and the bottom plate side of the clamping means and, when the clamping means is opened and the adhesive strip is entrained by the clamping plate side of the clamping means, strips the end of the adhesive strip from said clamping plate side.

* * * * *